US009835352B2

(12) United States Patent
Devenish et al.

(10) Patent No.: US 9,835,352 B2
(45) Date of Patent: Dec. 5, 2017

(54) METHOD FOR SAVING ENERGY EFFICIENT SETPOINTS

(71) Applicant: OPOWER, INC., Arlington, VA (US)

(72) Inventors: Ryan Devenish, San Francisco, CA (US); Monifa Porter, Washington, DC (US); Chris Kimm, San Francisco, CA (US); Robert Aaron Curry, Iowa City, IA (US); Seth Cousins, San Anselmo, CA (US)

(73) Assignee: OPOWER, INC., Arlington, VA (US)

( * ) Notice: Subject to any disclaimer, the term of this patent is extended or adjusted under 35 U.S.C. 154(b) by 537 days.

(21) Appl. No.: 14/494,362

(22) Filed: Sep. 23, 2014

(65) Prior Publication Data

US 2015/0267935 A1 Sep. 24, 2015

Related U.S. Application Data

(60) Provisional application No. 61/955,607, filed on Mar. 19, 2014.

(51) Int. Cl.
*G05B 21/00* (2006.01)
*G05B 13/00* (2006.01)
(Continued)

(52) U.S. Cl.
CPC ... *F24F 11/0086* (2013.01); *F24F 2011/0091* (2013.01)

(58) Field of Classification Search
CPC ..... F24F 11/0086; F24F 2011/0091
(Continued)

(56) References Cited

U.S. PATENT DOCUMENTS 4,334,275 A 6/1982 Levine
4,843,575 A 6/1989 Crane
(Continued)

FOREIGN PATENT DOCUMENTS

AU 2010315015 7/2014
CA 2779754 5/2011
(Continued)

OTHER PUBLICATIONS

International Search Report and Written Opinion for PCT Application No. PCT/US2015/038692, dated Sep. 24, 2015, 13 pages.
(Continued)

*Primary Examiner* — Mohammad Ali
*Assistant Examiner* — Md Azad
(74) *Attorney, Agent, or Firm* — Cooper Legal Group, LLC

(57) ABSTRACT

Techniques for saving energy efficient setpoints are described herein. A computing device can detect a change in a setpoint schedule based on setpoint data from a client computing device. The computing device can determine that the change in the setpoint schedule decreases energy consumption for a corresponding utility customer associated with the client computing device. The computing device can generate a notification including an indication that the change in the setpoint schedule decreases energy consumption for the corresponding utility customer. The computing device can further send the notification to the client computing device to cause a prompt to be displayed on a user interface of the client computing device, in which the prompt includes the sent notification. The computing device may cause a prompt to be displayed on the client computing device that includes options including an option to adopt the change in the setpoint schedule using the setpoint data.

21 Claims, 8 Drawing Sheets

(51) Int. Cl.

| | |
|---|---|
| ***G05B 15/00*** | (2006.01) |
| ***G05D 23/00*** | (2006.01) |
| ***G01M 1/38*** | (2006.01) |
| ***F24F 11/00*** | (2006.01) |

(58) Field of Classification Search
USPC ..... 700/278
See application file for complete search history.

(56) References Cited

U.S. PATENT DOCUMENTS 5,513,519 A 5/1996 Cauger et al.
5,539,633 A * 7/1996 Hildebrand ..... G05D 23/1904 700/32
5,566,084 A 10/1996 Cmar
5,717,609 A 2/1998 Packa et al.
5,855,011 A 12/1998 Tatsuoka
5,873,251 A 2/1999 Iino
5,930,773 A 7/1999 Crooks et al.
5,948,303 A 9/1999 Larson
6,035,285 A 3/2000 Schlect et al.
6,088,688 A 7/2000 Crooks et al.
6,295,504 B1 9/2001 Ye et al.
6,327,605 B2 12/2001 Arakawa et al.
6,701,298 B1 3/2004 Jutsen
6,732,055 B2 5/2004 Bagepalli et al.
6,778,945 B2 8/2004 Chassin et al.
6,785,620 B2 8/2004 Kishlock et al.
6,972,660 B1 12/2005 Montgomery, Jr. et al.
7,020,508 B2 3/2006 Stivoric et al.
7,073,073 B1 7/2006 Nonaka et al.
7,073,075 B2 7/2006 Freyman et al.
7,136,710 B1 11/2006 Hoffberg et al.
7,142,949 B2 11/2006 Brewster et al.
7,149,727 B1 12/2006 Nicholls et al.
7,200,468 B2 4/2007 Ruhnke et al.
7,243,044 B2 7/2007 McCalla
7,333,880 B2 2/2008 Brewster et al.
7,356,548 B1 4/2008 Culp et al.
7,444,251 B2 10/2008 Nikovski et al.
7,460,502 B2 12/2008 Arima et al.
7,460,899 B2 12/2008 Almen
7,552,030 B2 6/2009 Guralnik et al.
7,561,977 B2 7/2009 Horst et al.
7,991,513 B2 8/2011 Pitt
8,065,098 B2 11/2011 Gautam
8,091,795 B1 * 1/2012 McLellan ..... G05D 23/1923 236/51
8,166,047 B1 4/2012 Cohen et al.
8,180,591 B2 5/2012 Yuen et al.
8,239,178 B2 8/2012 Gray et al.
8,260,468 B2 9/2012 Ippolito et al.
8,275,635 B2 9/2012 Stivoric et al.
8,280,536 B1 10/2012 Fadell et al.
8,348,840 B2 1/2013 Heit et al.
8,375,118 B2 2/2013 Hao et al.
8,417,061 B2 4/2013 Kennedy et al.
8,478,447 B2 7/2013 Fadell et al.
8,489,245 B2 7/2013 Carrel et al.
8,583,288 B1 11/2013 Rossi et al.
8,630,741 B1 1/2014 Matsuoka et al.
8,660,813 B2 2/2014 Curtis et al.
8,690,751 B2 4/2014 Auphan
8,751,432 B2 6/2014 Berg-Sonne et al.
8,805,000 B2 8/2014 Derby et al.
9,031,703 B2 5/2015 Nakamura et al.
9,471,946 B1 * 10/2016 Keil ..... G06Q 50/06
2002/0065581 A1 5/2002 Fasca
2002/0178047 A1 11/2002 Or et al.
2002/0198629 A1 12/2002 Ellis
2003/0011486 A1 1/2003 Ying
2003/0018517 A1 1/2003 Dull et al.
2003/0023467 A1 1/2003 Moldovan
2003/0216971 A1 11/2003 Sick et al.
2004/0024717 A1 2/2004 Sneeringer
2004/0111410 A1 6/2004 Burgoon et al.
2004/0140908 A1 7/2004 Gladwin et al.
2005/0257540 A1 11/2005 Choi et al.
2006/0089851 A1 4/2006 Silby et al.
2006/0103549 A1 5/2006 Hunt et al.
2007/0061735 A1 3/2007 Hoffberg et al.
2007/0203860 A1 8/2007 Golden et al.
2007/0213992 A1 9/2007 Anderson et al.
2007/0255457 A1 11/2007 Whitcomb et al.
2007/0260405 A1 11/2007 McConnell et al.
2008/0027885 A1 1/2008 van Putten et al.
2008/0167535 A1 7/2008 Stivoric et al.
2008/0195561 A1 8/2008 Herzig
2008/0281473 A1 11/2008 Pitt
2008/0281763 A1 11/2008 Yliniemi
2008/0306985 A1 12/2008 Murray et al.
2009/0106202 A1 4/2009 Mizrahi
2009/0204267 A1 8/2009 Sustaeta et al.
2009/0326726 A1 12/2009 Ippolito et al.
2010/0025483 A1 2/2010 Hoeynck et al.
2010/0076835 A1 3/2010 Silverman
2010/0082174 A1 4/2010 Weaver
2010/0099954 A1 4/2010 Dickinson et al.
2010/0138363 A1 6/2010 Batterberry et al.
2010/0156665 A1 6/2010 Krzyzanowski et al.
2010/0179704 A1 7/2010 Ozog
2010/0198713 A1 8/2010 Forbes, Jr. et al.
2010/0217452 A1 8/2010 McCord et al.
2010/0217549 A1 8/2010 Galvin et al.
2010/0217550 A1 8/2010 Crabtree et al.
2010/0217642 A1 8/2010 Crubtree et al.
2010/0217651 A1 8/2010 Crabtree et al.
2010/0232671 A1 9/2010 Dam et al.
2010/0286937 A1 11/2010 Hedley et al.
2010/0289643 A1 11/2010 Trundle et al.
2010/0324962 A1 12/2010 Nesler et al.
2010/0332373 A1 12/2010 Crabtree et al.
2011/0022429 A1 1/2011 Yates et al.
2011/0023045 A1 1/2011 Yates et al.
2011/0040666 A1 2/2011 Crabtree et al.
2011/0046792 A1 * 2/2011 Imes ..... F24F 11/0086 700/278
2011/0061014 A1 3/2011 Frader-Thompson et al.
2011/0063126 A1 3/2011 Kennedy et al.
2011/0106316 A1 5/2011 Drew et al.
2011/0106328 A1 5/2011 Zhou et al.
2011/0106471 A1 5/2011 Curtis et al.
2011/0153102 A1 6/2011 Tyagi et al.
2011/0178842 A1 7/2011 Rane et al.
2011/0178937 A1 7/2011 Bowman
2011/0205245 A1 8/2011 Kennedy et al.
2011/0231320 A1 9/2011 Irving
2011/0251730 A1 10/2011 Pitt
2011/0251807 A1 10/2011 Rada et al.
2011/0282505 A1 11/2011 Tomita et al.
2012/0036250 A1 2/2012 Vaswani et al.
2012/0053740 A1 3/2012 Venkatakrishnan et al.
2012/0066168 A1 3/2012 Fadell et al.
2012/0072033 A1 * 3/2012 Imes ..... H04L 67/10 700/278
2012/0078417 A1 3/2012 Connell, II et al.
2012/0084063 A1 4/2012 Drees et al.
2012/0123594 A1 * 5/2012 Finch ..... G05B 15/02 700/278
2012/0215369 A1 8/2012 Desai et al.
2012/0216123 A1 8/2012 Shklovskii et al.
2012/0259678 A1 10/2012 Overturf et al.
2012/0290230 A1 11/2012 Berges Gonzalez et al.
2012/0310708 A1 12/2012 Curtis et al.
2013/0060531 A1 3/2013 Burke et al.
2013/0060720 A1 3/2013 Burke
2013/0173064 A1 7/2013 Fadell et al.
2013/0253709 A1 9/2013 Renggli et al.
2013/0261799 A1 10/2013 Kuhlmann et al.
2013/0262040 A1 10/2013 Buckley
2014/0006314 A1 1/2014 Yu et al.
2014/0019319 A1 1/2014 Derby et al.
2014/0074300 A1 3/2014 Shilts et al.
2014/0107850 A1 4/2014 Curtis

(56) References Cited

U.S. PATENT DOCUMENTS

| | | | | |
|---|---|---|---|---|
| 2014/0148706 | A1 | 5/2014 | Van Treeck et al. | |
| 2014/0163746 | A1 | 6/2014 | Drew et al. | |
| 2014/0207292 | A1 | 7/2014 | Ramagem et al. | |
| 2014/0316584 | A1* | 10/2014 | Matsuoka | G05D 23/1917 700/278 |
| 2014/0337107 | A1 | 11/2014 | Foster | |
| 2015/0198346 | A1* | 7/2015 | Vedpathak | G05B 15/02 700/278 |
| 2015/0227846 | A1 | 8/2015 | Mercer et al. | |
| 2015/0269664 | A1 | 9/2015 | Davidson | |
| 2015/0310019 | A1 | 10/2015 | Royer et al. | |
| 2015/0310463 | A1 | 10/2015 | Turfboer et al. | |
| 2015/0310465 | A1 | 10/2015 | Chan et al. | |

FOREIGN PATENT DOCUMENTS

| | | |
|---|---|---|
| CA | 2832211 | 11/2012 |
| DE | 3703387 | 8/1987 |
| DE | 102011077522 | 12/2012 |
| EP | 0003010 | 7/1979 |
| EP | 2705440 | 3/2014 |
| EP | 2496991 | 9/2014 |
| GB | 1525656 | 9/1978 |
| GB | 2238405 | 5/1991 |
| JP | 2000-270379 | 9/2000 |
| JP | 2004-233118 | 8/2004 |
| JP | 2006-119931 | 5/2006 |
| JP | 2007-133468 | 5/2007 |
| JP | 2011-027305 | 2/2011 |
| JP | 2012-080679 | 4/2012 |
| JP | 2012-080681 | 4/2012 |
| JP | 2013-020307 | 1/2013 |
| WO | WO 03/102865 | 12/2003 |
| WO | WO 03/104941 | 12/2003 |
| WO | WO 2008/101248 | 8/2008 |
| WO | WO 2009/085610 | 7/2009 |
| WO | WO 2011/057072 | 5/2011 |
| WO | WO 2012/112358 | 8/2012 |
| WO | WO 2012/154566 | 11/2012 |
| WO | WO 2014/004148 | 1/2014 |
| WO | WO 2014/182656 | 11/2014 |

OTHER PUBLICATIONS

International Preliminary Report on Patentability for PCT Application No. PCT/US2010/055621, dated May 15, 2012, 8 pages.
International Search Report and Written Opinion for PCT Application No. PCT/US2010/055621, dated Dec. 23, 2010, 9 pages.
International Search Report and Written Opinion for PCT Application No. PCT/US2012/036539, dated Jul. 6, 2012, 8 pages.
International Preliminary Report on Patentability for PCT Application No. PCT/US2012/036539, dated Nov. 21, 2013, 7 pages.
International Search Report and Written Opinion for PCT Application No. PCT/US2013/046126, dated Aug. 22, 2013, 9 pages.
International Preliminary Report on Patentability for PCT Application No. PCT/US2013/046126, dated Jan. 8, 2015, 8 pages.
International Search Report for PCT Application No. PCT/US2014/036901, dated Aug. 28, 2014, 3 pages.
Patent Examination Report No. 1 for Australian Patent Application No. 2010315015, dated Dec. 17, 2013, 3 pages.
Extended European Search Report for European Patent Application No. 12782569.3, dated Nov. 27, 2014, 7 pages.
Author Unknown, "An Inconvenient Truth," Jan. 9, 2008, 2 pages, available at http://web.archive.org/web/2008019005509/http://www.climatecrisis.net/takeaction/carbonca/.
Author Unknown, "Calculate Your Impact," Jul. 28, 2008, 4 pages, available at http://web.archive.org.web/20080728161614/http://green.yahoo.com/calculator/.
Author Unknown, "Carbon Footprint Calculator: What's My Carbon Footprint?" The Nature Conservancy, Jul. 8, 2008, 8 pages, available at http://web.archive.org/web/20080708193253/http://www.nature.org/initiatives/climatechange/calculator/2008.
Author Unknown, "CoolClimate Calculator," May, 19, 2008, 15 pages, available at http://web.archive.org/web/20080519220643/bie.berkley.edu/coolcale/calcualtions.html.
Author Unknown, "Lifecycle Climate Footprint Calculator," Berkeley Institute of the Environment, Nov. 23, 2007, 6 pages, available at http://web.archive.org/web/20071123115832/http://bie.berkeley.edu/calculator.
Author Unknown, "More than just a thermostat.," http://www.ecobee.com/, 4 pages, Jul. 16, 2013.
Author Unknown, "Popups Climate Change: Carbon Calculator—Greenhouse Gas and Carbon Dioxide Calculator Wed Pages," The Nature Conservancy, 5 pages, Feb. 29, 2008, available at http://web.archive.org/web/20080229072420/www.nature.org/popups/misc/art20625.html.
Bailey, Timothy, et al., "Fitting a Mixture Model by Expectation Maximization to Discover Motifs in Biopolymers," UCSD Technical Report CS94-351, Proceedings of the Second International Conf. on Intelligent Systems for Molecular Biology, 1994, 33 pages.
Chen, Hanfeng, et al., "Testing for a Finite Mixture Model With Two Components," Journal of the Royal Statistical Society, Series B, vol. 66, No. 1, 26 pages, 2004.
De Prensa, Boletine, "TXU Energy Budget Alerts Give Consumers Control of Electricity Costs," TXU Energy, http://www.txu.com/es/about/press, 2 pages, May 23, 2012.
Deb, Partha, "Finite Mixture Models," Hunter College and the Graduate Center, CUNY NBER, FMM Slides, 42 pages, Jul. 2008.
D'Urso, M., et al., "A Simple Strategy for Life Signs Detection Via an X-Band Experimental Set-Up," Progress in Electromagnectics Research C, vol. 9, pp. 119-129 (2009).
Eckmann, J.P., et al., "Ergodic theory of chaos and strange attractors," Reviews of Modern Physics, vol. 57, No. 3, Part I, pp. 617-656, Jul. 1985.
Espinoza, Marcelo, et al., "Short-Term Load Forecasting, Profile Identification, and Customer Segmentation: A Methodology Based on Periodic Time Series," IEEE Transactions on Power Systems, vol. 20, No. 3, pp. 1622-1630, Aug. 2005.
Fels, Margaret F., "PRISM: An Introduction," Elsevier Sequoia, Energy and Buildings, vol. 9, pp. 5-18, 1986.
Fels, Margaret F., et al., Seasonality of Non-heating Consumption and Its effect on PRISM Results, Elsevier Sequoia, Energy and Buildings, vol. 9, pp. 139-148, 1986.
Figueiredo, Vera, et al., "An Electric Energy Consumer Characterization Framework Based on Data Mining Techniques," IEEE Transactions on Power Systems, vol. 20, No. 2, pp. 596-602, May 2005.
Fitbit® Official Site, "Flex, One & Zip Wireless Activity & Sleep Trackers," http://www.fitbit.com/, 4 pages, Jul. 15, 2013.
Friedman, Jerome, et al., "Regularization Paths for Generalized Linear Models via Coordinate Descent," Journal of Statistical Sotfware, vol. 33, Iss. 1, pp. 1-22, Jan. 2010.
Goldberg, Miriam L., et al., "Refraction of PRISM Results into Components of Saved Energy," Elsevier Sequoia, Energy and Buildings, vol. 9, pp. 169-180, 1986.
Jansen, R.C., "Maximum Likelihood in a Generalized Linear Finite Mixture Model by Using the EM Algorithm," Biometrics, vol. 49, pp. 227-231, Mar. 1993.
Jawbone, "Know yourself. Live better." https://jawbone.com/up/, 7 pages, Jul. 15, 2013.
Leisch, Friedrich, "FlexMix: A General Framework for Finite Mixture Models and Latent Class Regression in R," Journal of Statistical Software, http://www.istatsoft.org/, vol. 11 (8), pp. 1-18, Oct. 2004.
Liang, Jian, et al. "Load Signature Study-Part II: Disaggregation Framework, Simulation, and Applications," IEEE Transactions on Power Delivery, vol. 25, No. 2, pp. 561-569, Apr. 2010.
Liang, Jian, et al., "Load Signature Study-Part I: Basic Concept, Structure, and Methodology," IEEE Transactions on Power Delivery, vol. 25, No. 2, pp. 551-560, Apr. 2010.
Mint.com, "Budgets you'll actually stick to," Budgeting-Calculate and Categorize your spending, https://www.mint.com/how-it-works/budgeting/, 2 pages, Jul. 12, 2013.

(56) References Cited

OTHER PUBLICATIONS

Mint.com, "We're always on alert." Alerts for bills, fees & going over budget, https://www.mint.com/how-it-works/alerts/, 2 pages, Jul. 12, 2013.
Mori, Hiroyuki, "State-of-the-Art Overview on Data Mining in Power Systems," IEEE, pp. 33-37, 2006.
Muthen, Bengt, et al., Finite Mixture Modeling with Mixture Outcomes Using the EM Algorithm, Biometrics, vol. 55, pp. 463-469, Jun. 1999.
NEST, "The Learning Thermostat," http://www.nest.com/, 2 pages, Jul. 15, 2013.
Nike.com, "Nike + FuelBand. Tracks your all-day activity and helps you do more. . . ," http://www.nike.com/us/en_us/c/nikeplus-f..uelband 7 pages, Jul. 15, 2013.
Rose, O. "Estimation of the Hurst Parameter of Long-Range Dependent Time Series," University of Wuirzburg, Institute of Computer Science, Research Report Series, Report No. 137, 15 pages, Feb. 1996.
Sawka, Michael N., et al., "Human Adaptations to Heat and Cold Stress," RTOMP-076, 16 pages, Oct. 2001.
Stephen, Bruce, et al. "Domestic Load Characterization Through Smart Meter Advance Stratification," IEEE Transactions on Smart Grid, Power Engineering Letter, vol. 3, No. 3, pp. 1571-1572, Sep. 2012.
Stoop, R., et al., "Calculation of Lyapunov exponents avoiding spurious elements," Physica D 50, pp. 89-94, May 1991.
Wang, Xiaozhe, et al. "Rule induction for forecasting method selection: meta-learning the characteristics of univariate time series," Faculty of information Technology, Department of Econometrics and Business Statistics, Monash University, pp. 1-34.
Wang, Xiaozhe, et al., "Characteristic-Based Clustering for Time Series Data," Data Mining and Knowledge Discovery, Springer Science & Business Media, LLC, vol. 13, pp. 335-364 (2006).
Wehrens, Ron, et al. "Self- and Super-organizing Maps in R: The kohonen Package," Journal of Statistical Software, vol. 21, Iss. 5, pp. 1-19, Oct. 2007.
Wikipedia, "Akaike information criterion," 6 pages, Aug. 17, 2012.
Wikipedia, "Mixture model," 10 pages, Oct. 7, 2012.

* cited by examiner

METHOD FOR SAVING ENERGY EFFICIENT SETPOINTS

CROSS-REFERENCE TO RELATED APPLICATIONS

The present application claims the benefit of priority to U.S. Provisional Application Ser. No. 61/955,607, filed Mar. 19, 2014, titled "METHOD FOR SAVING ENERGY EFFICIENT SETPOINTS," of which is hereby incorporated by reference in its entirety.

BACKGROUND

The subject technology relates to data processing systems, and in particular, to a method for saving energy efficient setpoints.

Users of smart climate control devices (e.g., smart thermostats) can control their thermostat setpoints remotely using mobile devices. In this approach, setpoints can be controlled in two ways. First, users can create setpoint schedules, whereby their setpoints change at specific times of the day. Second, users can manually manipulate their setpoints in real time. Although users can program setpoints, the setpoints chosen can always be improved upon to decrease energy consumption. This is because energy conservation is a continuum. Additionally, once users choose their setpoint schedules, out of convenience, the users may not choose to make changes to their setpoint schedules.

SUMMARY

According to various aspects of the subject technology, a method for saving energy efficient setpoints is described.

In an aspect, a computing device for saving energy efficient setpoints is described herein. The computing device includes at least one processor and memory storing instructions that, when executed by the at least one processor, cause the computing device perform several operations. The computing device can detect a change in a setpoint schedule based on setpoint data from a client computing device. In this regard, the setpoint schedule includes one or more setpoints that correspond to different temperature settings for the client computing device. The computing device can determine that the change in the setpoint schedule decreases energy consumption for a corresponding utility customer associated with the client computing device. The computing device can send data to the client computing device to cause a prompt to be displayed on a user interface of the client computing device, the prompt including one or more options including an option to adopt the change in the setpoint schedule using the setpoint data. The computing device can further receive an input based at least in part on the prompt. In this respect, the input includes a selection of at least one of the one or more options such that the setpoint schedule is changed using the setpoint data based on the selected option corresponding to the option to adopt the change in the setpoint schedule.

In another aspect, a computer-implemented method for saving energy efficient setpoints is described herein. The method includes a step for detecting a change in a setpoint schedule based on setpoint data from a client computing device. The method includes a step for determining that the change in the setpoint schedule decreases energy consumption for a corresponding utility customer associated with the client computing device. The method also includes a step for generating a notification including an indication that the change in the setpoint schedule decreases energy consumption for the corresponding utility customer. The method further includes a step for sending the notification to the client computing device to cause a prompt to be displayed on a user interface of the client computing device, in which the prompt includes the sent notification.

In still another aspect, a non-transitory computer readable storage medium storing instructions for saving energy efficient setpoints on a computing device, the instructions when executed by a processor cause the computing device to perform several operations. The computing device can detect a change in a setpoint schedule based on setpoint data from a client computing device. The computing device can determine that the change in the setpoint schedule provides a benefit for a corresponding utility customer associated with the client computing device. The computing device can generate a notification including an indication that the change in the setpoint schedule decreases energy consumption for the corresponding utility customer. The computing device can send the notification to the client computing device. The computing device can send data to the client computing device to cause a prompt to be displayed on a user interface of the client computing device. In this regard, the prompt includes the notification and one or more options including an option to adopt the change in the setpoint schedule using the setpoint data. The computing device can further receive an input based at least in part on the prompt. In this respect, the input includes a selection of at least one of the one or more options such that the setpoint schedule is changed using the setpoint data based on the selected option corresponding to the option to adopt the change in the setpoint schedule.

BRIEF DESCRIPTION OF THE DRAWINGS

In the following description, reference is made to the following figures, and in which are shown by way of illustration specific embodiments in which the subject technology may be practiced. It is to be understood that other embodiments may be utilized and changes may be made without departing from the scope of the subject technology.

DETAILED DESCRIPTION

Figure 1:
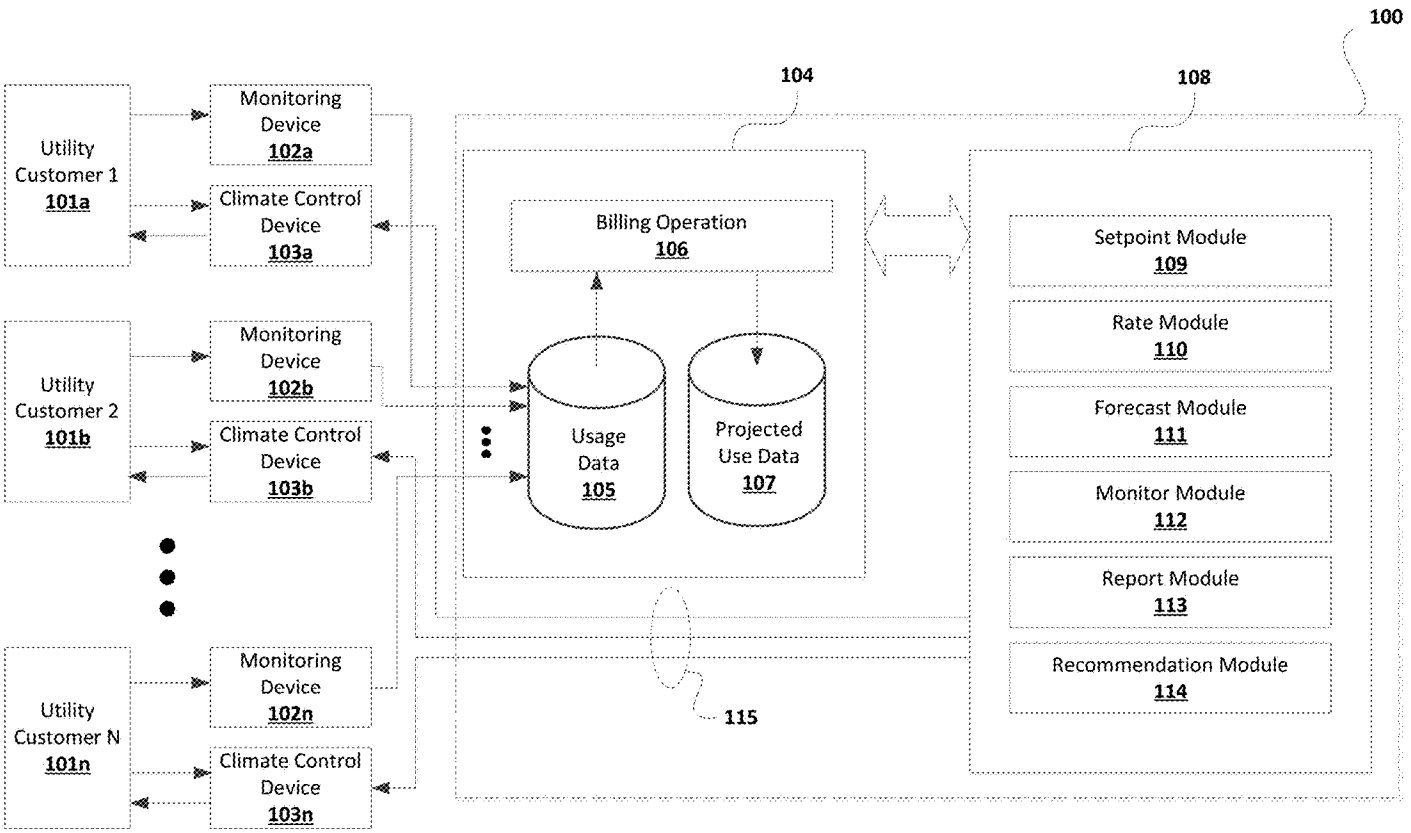
FIG. 1 illustrates an example of an energy usage management system, according to certain aspects of the subject technology.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form in order to avoid obscuring the concepts of the subject technology.

There is no conventional approach in curing the above-noted drawbacks for saving energy efficient setpoints other than resources that provide general suggestions about what setpoints are optimal and estimated cost saving based on changing setpoints. In this respect, the subject technology allows for a means to encourage individuals to adopt more conservative energy consumption practices. The subject technology bridges the gap between a user's choice to override their setpoint schedule to be more efficient and programming that decision to their permanent setpoint schedules. The subject technology encourages people to increase efficiency by: (1) alerting them when they have taken a step towards being more energy efficient and (2) making it easy to save their decision. In addition, the subject technology prompts users when a particular change to their setpoints causes financial savings to exceed a certain amount, and informs the users of what their savings would be if they adopted the new setpoint.

In some aspects, one or more computing devices (e.g., an energy billing management system) can perform several operations for saving energy efficient setpoints. For example, a computing device can detect a change in a setpoint schedule based on setpoint data from a client computing device. The computing device can determine that the change in the setpoint schedule decreases energy consumption for a corresponding utility customer associated with the client computing device. The computing device can generate a notification including an indication that the change in the setpoint schedule decreases energy consumption for the corresponding utility customer. The computing device can send the notification to the client computing device. The computing device can send data to the client computing device to cause a prompt to be displayed on a user interface of the client computing device. In this regard, the prompt includes the notification and one or more options including an option to adopt the change in the setpoint schedule using the setpoint data. The computing device can further receive an input based at least in part on the prompt. In this respect, the input includes a selection of at least one of the one or more options such that the setpoint schedule is changed using the setpoint data based on the selected option corresponding to the option to adopt the change in the setpoint schedule.

The term "setpoint" described herein refers to a programmable control signal corresponding to a defined temperature as a setting in a climate control device. The term "setpoint schedule" described herein refers to a set of setpoints corresponding to temperature settings for different times during a specified time period. The "system" described herein may be implemented on a server, a climate control device, or on a computing device in communication with the climate control device. The climate control device may represent one or more of a conventional thermostat, a smart thermostat, an application running on a computing device, or a computing device coupled to the thermostat depending on implementation. The term "usage" described herein refers to a quantity of use, a cost associated with the use, or a quantified metric representing the use or cost. The term "commodity" described herein refers to a utility-based commodity, such as electricity, water, and natural gas, which are consumable finite resources delivered to a dwelling or a commercial structure. The term "component of a property" described herein refers to a component associated with the property that is able to consume a commodity. One example of a component of a property may be a heating, ventilation and air conditioning (HVAC) system that controls the climate within the property using electricity, natural gas, and/or another commodity. The component may relate to one or more of a central heating device, a central air conditioning and heating system, an appliance, an electronic device, water heating system, a power generating device, a ventilation system, or an air filtration system. The term "network connected thermostat" as described herein refers to a smart thermostat that is connected to smart thermostat software.

FIG. 1 illustrates an example of an energy usage system 100, according to certain aspects of the subject technology. The energy usage system 100 includes a utility management system 104 and a billing management system 108. The utility management system 104 is coupled to utility customers 101 via monitoring devices 102 and climate control devices 103. The utility management system 104 includes usage database 105, a billing operation module 106 and projected use database 107. The billing management system 108 includes a setpoint module 109, a rate module 110, a forecast module 111, a monitor module 112, a report module 113 and a recommendation module 114. The billing management system 108 may convey information targeted to one or more of the utility customers 101*a*-101*n* over communication channels 115.

The utility management system 104 stores usage data in the usage database 105. The usage data is associated with one or more commodities consumed by the utility customers 101. The usage data may include usage information corresponding to usage of at least one of the one or more commodities for multiple utility customers (e.g., utility customers 101*a*, 101*b* . . . 101*n*). The usage-information may include past usage information of the commodity during at least one of completed billing period and a current usage of the at least one of the one or more commodities during a completed portion of a current billing period. The usage data for a utility customer may be obtained from a corresponding monitoring device on a scheduled basis, periodic basis or a non-scheduled basis. The monitoring devices (e.g., monitoring devices 102*a*, 102*b* . . . 102*n*) may relate to an advanced metering infrastructure (AMI). In this respect, the monitoring devices may be smart meters or, at least in part, include smart meter functionality for measuring electrical, water and/or natural gas consumption in the property associated with the corresponding utility customer. For example, the usage data may consist of usage information corresponding to the property in its entirety such that usage information relating to one or more components in the property is disaggregated by the utility management system 104 and/or the billing management system 108. In an aspect, the utility management system 104 stores and forwards the usage data to the billing management system 108 for usage alert processing. The utility management system 104 may forward the usage data to the billing management system 108 for storage and usage alert processing. The utility management system 104 described herein may refer to a utility company or an offsite third party service provider that is interfaced with the utility company.

The utility management system 104 stores projected use information in the projected use database 107. The projected use information may be based on the usage data and estimated usage for a remaining amount of time in the current billing period. For example, the billing operation module 106 may obtain the usage data to determine a rate of use for the corresponding utility customer. The rate of use may be based on the amount of energy consumed over a specified number of days, for example. The rate of use may be applied to the remaining amount of time to determine the estimated usage. As such, the projected use information may consist of the usage data to date and the estimated usage for the remaining time in the billing period. A more detailed description of the projected use determination will be described in FIG. 2.

The setpoint module 109 may determine a change in a setpoint schedule based on a comparison between a current setpoint corresponding to a new temperature and a previously scheduled setpoint corresponding to an old temperature. In an aspect, the setpoint module 109 may determine that the change in the setpoint schedule can cause a change (e.g., a decrease or increase) in energy consumption and/or determine that the corresponding utility customer can realize a projected financial benefit if the new temperature is adopted (or saved) into the setpoint schedule. The rate module 110 may store a local copy of a rate schedule associated with the fees for commodities provided by the utility company. The rate module 110 may be configured to obtain the rate schedule, associated with the current billing period, from the utility company. The forecast module 111 may be configured to forecast the projected use of energy by the utility customers 101*a*-101*n* based on the corresponding usage data. The forecast module 111 may include an algorithm used to determine the projected use information using rate of use information and billing period information. The monitor module 112 may include an interface to the monitoring devices 102*a*-102*n* to obtain the usage data directly and/or include an interface with the utility management system 104 to receive the usage data for further processing by one or more components of the billing management system 108 (e.g., projected use information, rate of use information, target budgets). The report module 113 may be configured to generate a usage alert notification, and cause the usage alert notification to be sent to one or more of the utility customers 101*a*-101*n* based on one or more reporting conditions (e.g., projected bill exceeding target budget, current billing period ended, utility customer inquiry, etc.) through the communication channels 115.

The recommendation module 114 may be configured to generate one or more recommendation messages for inclusion into an energy usage notification and/or a separate notification to the utility customers 101*a*-101*n*. For example, the recommendation messages may relate to a recommendation to adopt a current setpoint (different from a scheduled setpoint) to incentivize a targeted utility customer to improve energy conservation at the home and/or inform the targeted utility customer of possible cost savings in future energy bills. The one or more recommendation messages may include information regarding how much the user may need to pay additional per year (e.g., loss-aversion information) if the current setpoint is not adopted into the setpoint schedule.

The communication channels 115 may carry alert notifications to the utility customers 101*a*-101*n* over a wired and/or a wireless communication. In an aspect, the billing management system 108 sends the alert notifications in a broadcast and/or multicast signal to the utility customers 101*a*-101*n* via the climate control devices 103*a*-103*n*. The billing management system 108 may specifically target one or more of the utility customers 101*a*-101*n*, and send a personalized alert notification over a unicast signal. The communication channels 115 may be configured to interface to a smart meter (e.g., the monitoring devices 102*a*-102*n*), a thermostat (e.g., the climate control device 103*a*-103*n*), a customer's mobile device, a data exchange interface of a cellular network, and other networks.

In operation, the energy usage system 100 allows for a target budget to be set for each of the utility customers 101*a*-101*n*, a projected use to be calculated for the utility customer 101 based on the retrieved usage data for that utility customer, and a budgeting communication to be transmitted to a climate control device 103 (e.g., a smart thermostat) of that utility customer if the projected use is determined to be greater than the target budget. In certain implementations, the budgeting communication may cause the thermostat to alert the utility customer that the utility customer's resource usage is projected to exceed the targeted budget, provide recommendations on how to meet the targeted budget, and/or automatically adjust thermostat settings to meet the targeted budget.

Figure 2:
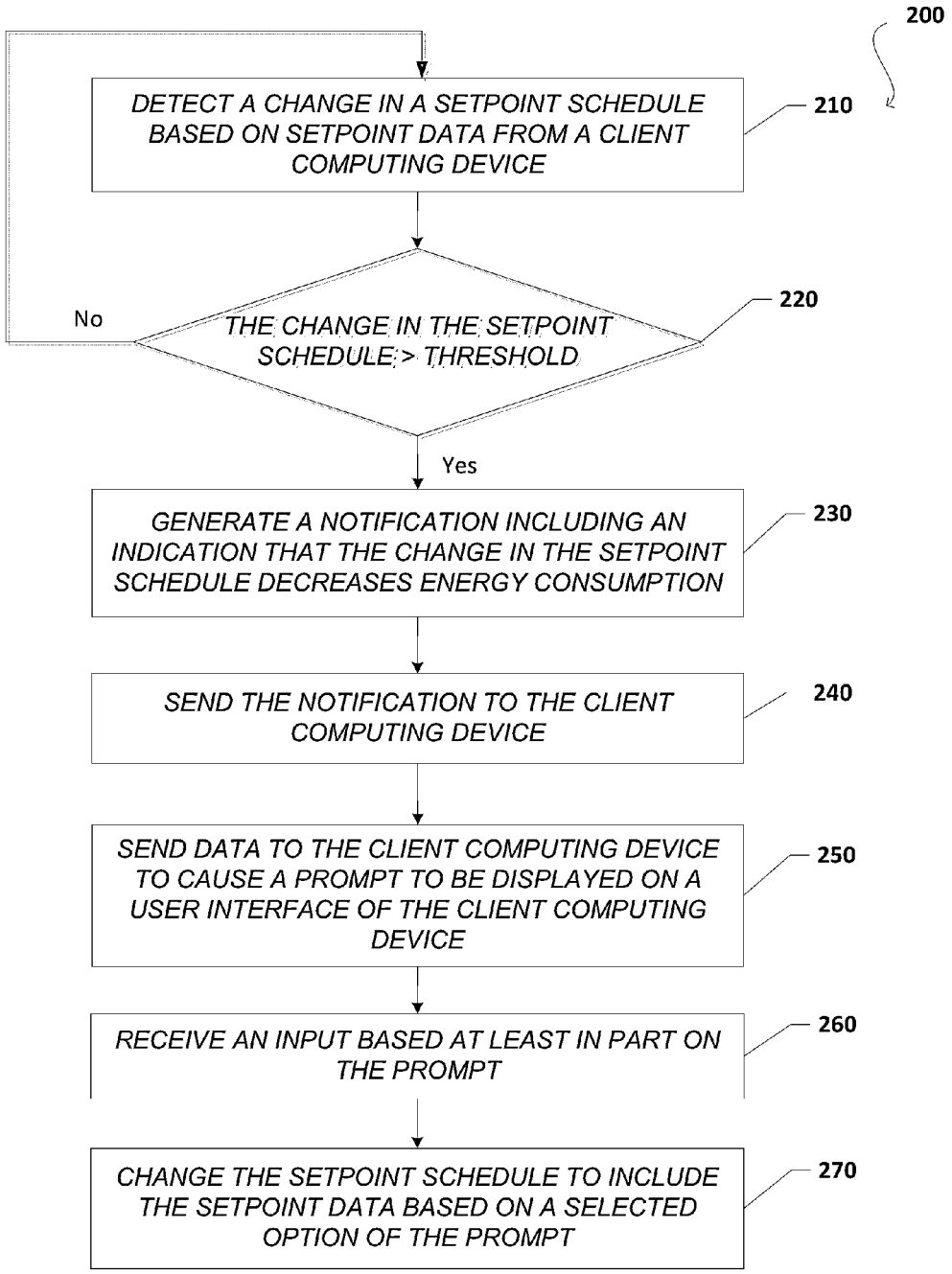
FIG. 2 illustrates a flowchart of an example process for saving energy efficient setpoints in the energy usage management system described in FIG. 1, according to certain aspects of the subject technology.

FIG. 2 illustrates a flowchart of an example process 200 for saving energy efficient setpoints in the energy usage system described in FIG. 1, according to certain aspects of the subject technology. In some embodiments, the process 200 may be performed by the energy usage system 100, a client device (e.g., a climate control device 103), or a combination of computing devices. The example process 200 is provided merely as an example and additional or fewer steps may be performed in similar or alternative orders, or in parallel, within the scope of the various embodiments described in this specification.

Figure 6:
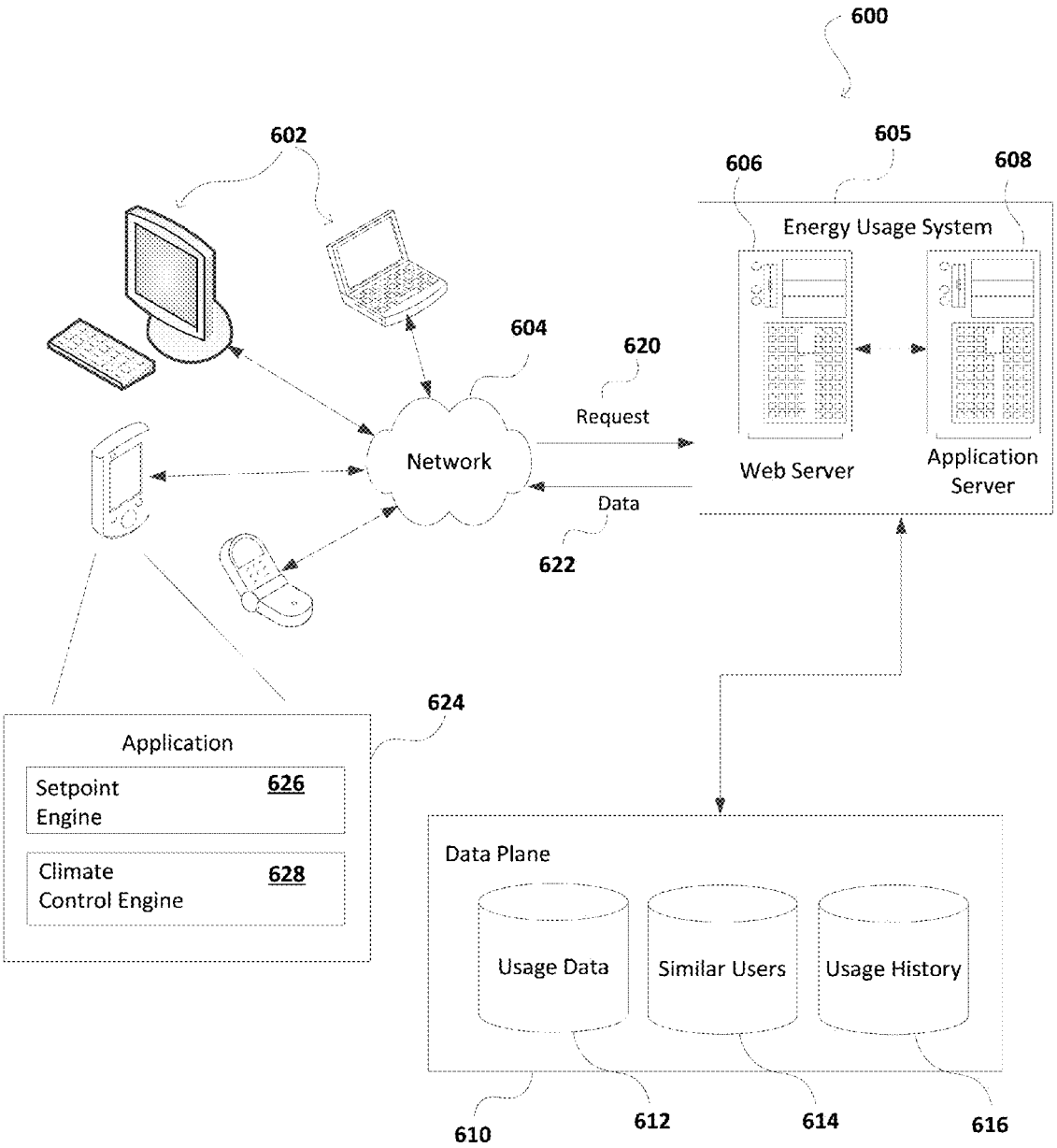
FIG. 6 illustrates an example of a system for saving energy efficient setpoints, according to certain aspects of the subject technology.

In step 210, a computing device (e.g., energy usage system 605 of FIG. 6) can detect a change (e.g., a temporary change in setpoint temperature input by a user) in a setpoint schedule based on setpoint data from a client computing device (e.g., client devices 602 of FIG. 6). In an aspect, the change in the setpoint schedule is detected based at least in part on a difference between a current setpoint included in the setpoint data and a scheduled setpoint included in the setpoint schedule. In this regard, the difference may correspond to an amount of degrees difference in temperature. In this embodiment, the current setpoint and/or scheduled setpoint may derive from recommended setpoints published by a government agency such as the Environmental Protection Agency (EPA). The EPA may publish to the public articles and/or digital content relating to recommendations concerning thermostat settings to guide energy users of settings likely to cause a decrease in energy consumption.

In some aspects, the computing device identifies one or more client computing devices including the client computing device connected over a network. The network may be a wired or a wireless communication network (e.g., peer-to-peer, Bluetooth®, Wi-Fi, etc.). The computing device may be configured to obtain a respective setpoint schedule for each of the one or more client computing devices on the network. In this regard, the computing device may individually request for the setpoint schedules or the computing device may access a repository (or database) containing the setpoint schedules. For example, the computing device may obtain the setpoint schedule associated with the client computing device from a repository communicatively coupled to the client computing device. During operation, the computing device may receive a request from the client computing device to change a scheduled setpoint included in the setpoint schedule to a current setpoint included in the request. In this respect, the change in the setpoint schedule discussed above may be detected in response to the request.

In one embodiment, the computing device obtains the setpoint schedule as an original setpoint schedule, and the computing device may be configured to adjust the setpoint schedule by either replacing the scheduled setpoint included in the setpoint schedule with the current setpoint included in the setpoint data or adding the current setpoint into the setpoint schedule. In turn, the computing device can store the adjusted setpoint schedule as a new setpoint schedule into a repository associated with the client computing device or at least a data structure accessible by the client computing device.

In step 220, the computing device can determine that the change in the setpoint schedule decreases energy consumption for a corresponding utility customer (or user) associated with the client computing device. In an aspect, the computing device can determine that the amount of degrees is greater than a first threshold. In other words, the difference in degrees between the previously scheduled setpoint and the current setpoint is greater than the first threshold. In turn, the change may be determined to decrease energy consumption based on the amount of degrees determined to be greater than the first threshold.

In some aspects, the first threshold may relate to a threshold amount of money. In this respect, the difference between the cost associated with the previously scheduled setpoint and the cost associated with the current setpoint would yield a cost savings that is greater than the first threshold if the current setpoint is adopted into the setpoint schedule.

In one embodiment, the first threshold may be set by a user associated with a climate control device communicatively coupled to the computing device. In this regard, the user may have knowledge relating to the cost savings corresponding to the first threshold. In another aspect, the first threshold may be predetermined by a third party (e.g., the utility company setting the applicable rate plan or a government agency such as the Environmental Protection Agency (EPA)). As shown in FIG. 2, if the change in the setpoint schedule is greater than the first threshold, then process 200 proceeds to step 230. Otherwise, the process proceeds back to step 210.

In step 230, the computing device can generate a notification including an indication that the change in the setpoint schedule decreases energy consumption for the corresponding utility customer. In step 240, the computing device can send the notification to the client computing device. The notification may include one or more of information relating to informing the user when he or she is making an energy saving decision, information relating to informing the user when he or she is making a cost saving decision, information relating to informing the user how much a decision of the user will save the user in comparison to a current practice of the user, information relating to increasing energy conservation in residential homes, or information relating to enabling smart thermostat users to change setpoint schedules of the users upon occurrence of a certain event.

In step 250, the computing device can send data to the client computing device to cause a prompt to be displayed on a user interface of the client computing device, the prompt including the notification and one or more options including an option to adopt the change in the setpoint schedule for subsequent periods of time using the setpoint data. For example, the client computing device is a thermostat that provides the user interface with which the user may select the one or more options. In some aspects, the client computing device is communicatively coupled to a thermostat (e.g., the climate control devices 103*a*-103*n*) configured to display the prompt on the thermostat interface. In an aspect, the computing device can automatically select the option corresponding to the temperature setting (or current setpoint) that causes the decrease in energy consumption. In this regard, the user may confirm the system selected option to adopt the current setpoint, and the adjusted setpoint schedule may be provided to the client computing device.

In some aspects, the user interface is associated with an application configured to run on the client computing device. In this respect, one or more users may be allowed to access the user interface to remotely manipulate one or more climate control devices communicatively coupled to the client computing device over a network.

The user interface may include an object representing a temperature dial for controlling one or more scheduled setpoints of the setpoint schedule. As will be discussed in FIGS. 3A and 3B, the temperature dial may include one or more icons as graphical symbols representing setpoints of the setpoint schedule. The client computing device, as will be discussed in FIG. 7, may include a touchscreen as an input device such that the client computing device can detect one or more touch gestures on the temperature dial. In this embodiment, the one or more touch gestures may correspond to a manipulation of the temperature dial to provide at least one input to the user interface. The at least one input may correspond to the change in the setpoint schedule detected by the computing device.

In an aspect, the at least one input corresponds to a current setpoint of the setpoint data. In this respect, the computing device can determine that the current setpoint is lower than a scheduled setpoint of the setpoint schedule. For example, the scheduled setpoint may correspond to 80° F. whereas the current setpoint corresponds to 75° F. In this regard, the change detected in the setpoint schedule may relate to an improvement in energy conservation based on the current setpoint being lower than the scheduled setpoint when the client computing device is set to a heating mode. In this embodiment, the process of heating the home may not have to reach 80° F. but rather 75° F. thus conserving energy in heating the home to a lower requested temperature.

Alternatively, the computing device may determine that the current setpoint is higher than the scheduled setpoint of the setpoint schedule when the client computing device is set to a cooling mode. In this respect, the change detected in the setpoint schedule relates to an improvement in energy conservation based on the current setpoint being higher than the scheduled setpoint. For example, the scheduled setpoint may correspond to 68° F. whereas the current setpoint corresponds to 73° F. In this example, the process of cooling the home may not have to reach 68° F. but rather 73° F. thus conserving energy in cooling the home to a higher requested temperature.

In one embodiment, the user interface includes an object representing a metric of multiple users within a population of climate control devices connected to the client computing device over a network. The object may include an indication of where the user lies with respect to the users in terms of efficiency based on setpoint schedules of the users. For example, the object may be a sliding bar presented concurrently with the temperature dial on the user interface whereby the indicator can slide along a horizontal axis on the sliding bar to a location on the sliding bar that corresponds to the efficiency value.

In some aspects, the computing device sends data to the client computing device to cause an associated climate control device to be set into a cooling mode. For example, the setpoint schedule rendered on the client computing device can be used to manipulate the state (or mode) of the associated climate control device (e.g., smart thermostat). Alternatively, the climate control device may be set into the cooling mode by an action performed by the user on the climate control device. In the cooling mode, the computing device can determine that a current setpoint included in the setpoint data (e.g., data received from the client computing device) is greater than a scheduled setpoint included in the setpoint schedule (e.g., new temperature is higher than programmed temperature). In turn, the computing device can send a notification to the client computing device based on the current setpoint being greater than the scheduled setpoint to inform the user of a projected financial benefit that would result from the current setpoint being stored as part of the setpoint schedule. For example, the new temperature setting (or current setpoint) could save the user a significant amount of money in future energy bills while able to reduce energy consumption in the home.

Alternatively, the computing device can send additional data to the client computing device to cause the climate control device to be set into a heating mode. In the heating mode, the computing device can determine that the current setpoint is smaller than the scheduled setpoint, and send the notification to the client computing device based on the current setpoint being smaller than the scheduled setpoint.

In determining the possible cost savings to the user, the computing device can determine that the projected financial benefit is greater than a predetermined threshold. For example, the cost savings may result from the difference between the cost associated with the current setpoint and the cost associated with the previously scheduled setpoint exceeding the predetermined threshold.

In some aspects, the cost savings associated with a temporary change in the setpoint schedule (e.g., the current setpoint) can be detected independent of energy efficiency. For example, the computing device may determine that the change in the setpoint schedule could save the user money, and therefore, generate a notification to the user regarding the possible cost savings with the current setpoint even though the change in the setpoint schedule may not necessarily yield energy efficiency.

The predetermined threshold may be specified by the user (e.g., utility customer) or a third party service provider (e.g., the utility company). For example, the predetermined threshold may represent a specific monetary value that the user would consider a financial benefit. Detection of the projected financial benefit can trigger the computing device to generate a notification including loss-aversion information to incentivize the user to adopt the current setpoint. The loss-aversion information may indicate what additional costs the user may realize if the new temperature (or current setpoint) is not adopted. For example, the loss-aversion information can include a statement such as "Not saving this temperature could cost you around $30 this year." In turn, the computing device can send data including the notification to cause a prompt to be displayed on the user interface of the client computing device whereby the prompt includes the loss-aversion information. The projected financial benefit may be based at least in part on an energy usage history of the user, the energy usage history relating to one or more of an average usage rate for a specified number of months, a usage rate during a specified budget period for one or more previous years, an average usage rate for a particular weekday or weekend, usage rates for one or more months preceding the specified budget period, and energy usage billing information for a specified number of months in one or more previous years.

The computing device may review energy usage data and determines how much a given user spends (or consumes) on cooling and heating. In addition, the computing device can determine the cost of energy given the rate of consumption (e.g., rate-of-use). In some aspects, the computing device forecasts how much incremental deviations would save the user based on a same rate of consumption and energy cost.

In step 260, the computing device can receive an input based at least in part on the prompt. The input may include a selection of at least one of the one or more options. For example, the prompt may ask the user whether to save (or store) the current setpoint by selecting "NO" or "SAVE," for example, In step 270, the computing device can change the setpoint schedule to include the setpoint data based on the selected option that corresponds to the option to store the change in the setpoint schedule.

In some aspects, the computing device can determine that the change in the setpoint schedule corresponds to a projected financial benefit that is greater than a second threshold. The projected financial benefit may relate to a cost savings to the user for one or more billing cycles. For example, the user may save an incremental amount of money (e.g., $20) by reducing the thermostat setting (e.g., scheduled setpoint) to the requested temperature (e.g., current setpoint) at a particular time of the day or for a duration of time in the day. In turn, the computing device can generate a notification including information relating to the projected financial benefit to inform the user of the client computing device that the projected financial benefit is based on the user adopting the current setpoint as a new scheduled setpoint in the setpoint schedule. The computing device can further send the notification to the client computing device to cause the prompt to be displayed on the user interface of the client computing device. The prompt can include the information relating to the projected financial benefit to convey the potential monetary savings to the user while helping to improve energy conservation.

Figure 3A:
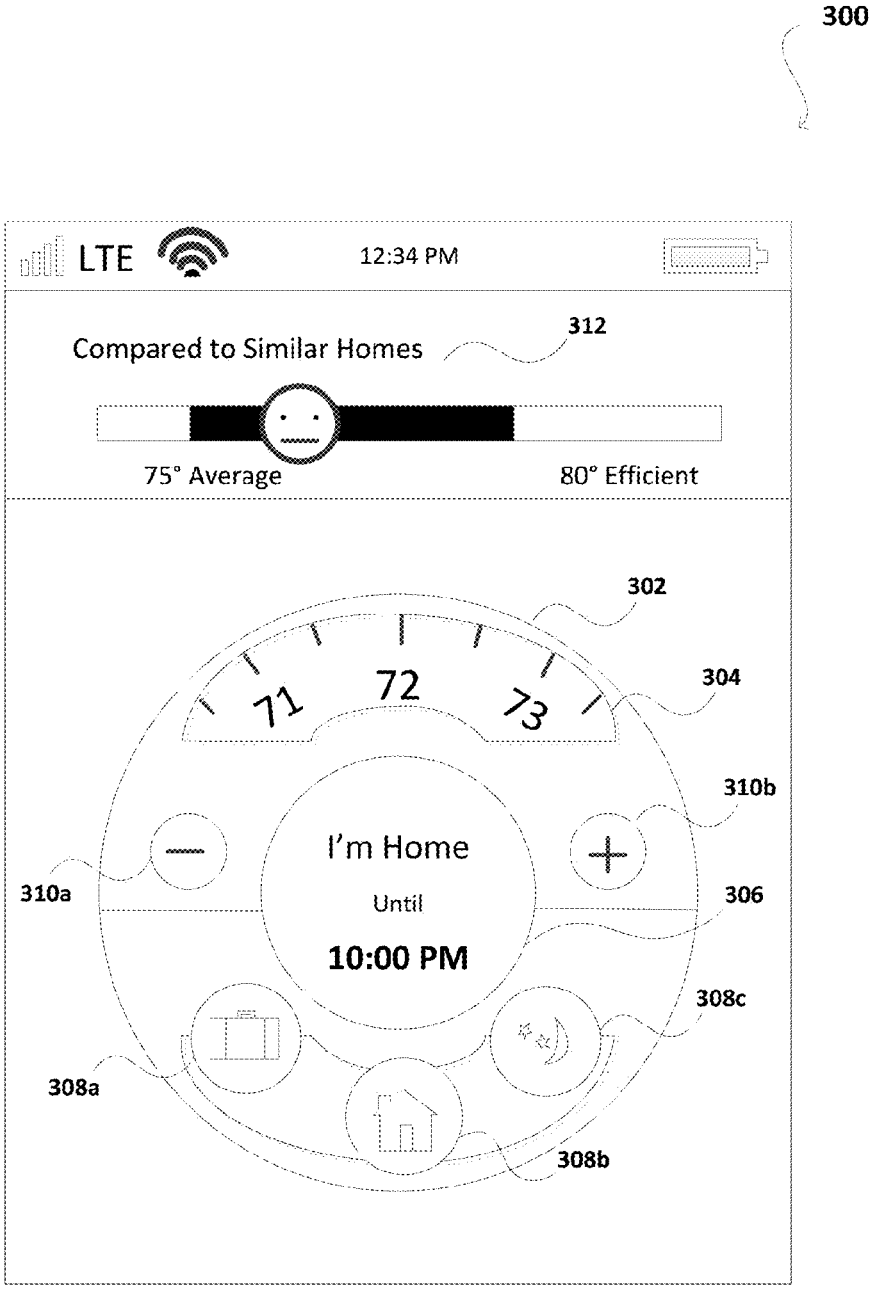
FIGS. 3A-B illustrate examples of a setpoint control interface, according to certain aspects of the subject technology.

FIG. 3A illustrates an example of a setpoint schedule interface 300, according to certain aspects of the subject technology. The setpoint schedule interface 300 includes a setpoint interface 302 and an efficiency bar 312. The setpoint schedule interface 300 is provided merely as an example and additional or fewer features may be included in similar or alternative formats within the scope of the various embodiments described in this specification.

The setpoint schedule interface 300 may be an interface for an application configured to run on a mobile device (e.g., client computing device) in order to allow the user to manipulate one or more setpoints of a setpoint schedule. As will be discussed in FIG. 6, the setpoint schedule interface 300 may be rendered on a display screen of different types of client devices with similar and/or varied functionality.

The setpoint interface 302 includes a temperature dial 304, a status identifier 306, themed setpoint buttons 308*a-c*, and control buttons 310*a-b*. The temperature dial 304 includes numbers (e.g., 71, 72, and 73) that correspond with the temperature an associated climate control device is set to. The temperature can be manually changed in real time using one or more of the control button 310*a* (e.g., "+") or control button 310*b* (e.g., "–") or by scrolling the temperature dial 304. The status identifier 306 may represent a notification regarding a location status of the user since the themed setpoint buttons 308*a-c* may be configured to vary the temperature depending on the location of the user and/or time of day. For example, the status identifier 306 may include a statement such as "I'm Home until 10:00 PM" to indicate that the themed setpoint button 308*b* should be activated until 10:00 PM, and thereafter, the themed setpoint button 308*a* to set the temperature while the user is away from the home.

The themed setpoint buttons 308*a-c* represent three times users can schedule their setpoints. In some aspects, the number of times for scheduling setpoints can vary from three predetermined times as shown in FIG. 3A. For example, themed setpoint button 308*a* corresponds to a "briefcase" that represents a temperature while the user is away at work. The themed setpoint button 308*b* corresponds to a "home" that represents a temperature while the user is at the home. The themed setpoint button 308*c* corresponds to a "moon and starts" that represents a temperature at night while the user is asleep.

The efficiency bar 312 (located above the setpoint interface 302) represents the efficiency continuum of all users within the population of network connected thermostats. The indicator may be an ideogram that marks where the user lies in relation to other users in terms of the efficiency of their setpoints. The efficiency bar 312 is not necessarily constrained to the location as shown in FIG. 3A, and can be positioned in a different location of the setpoint schedule interface 300 depending on implementation.

Figure 3B:
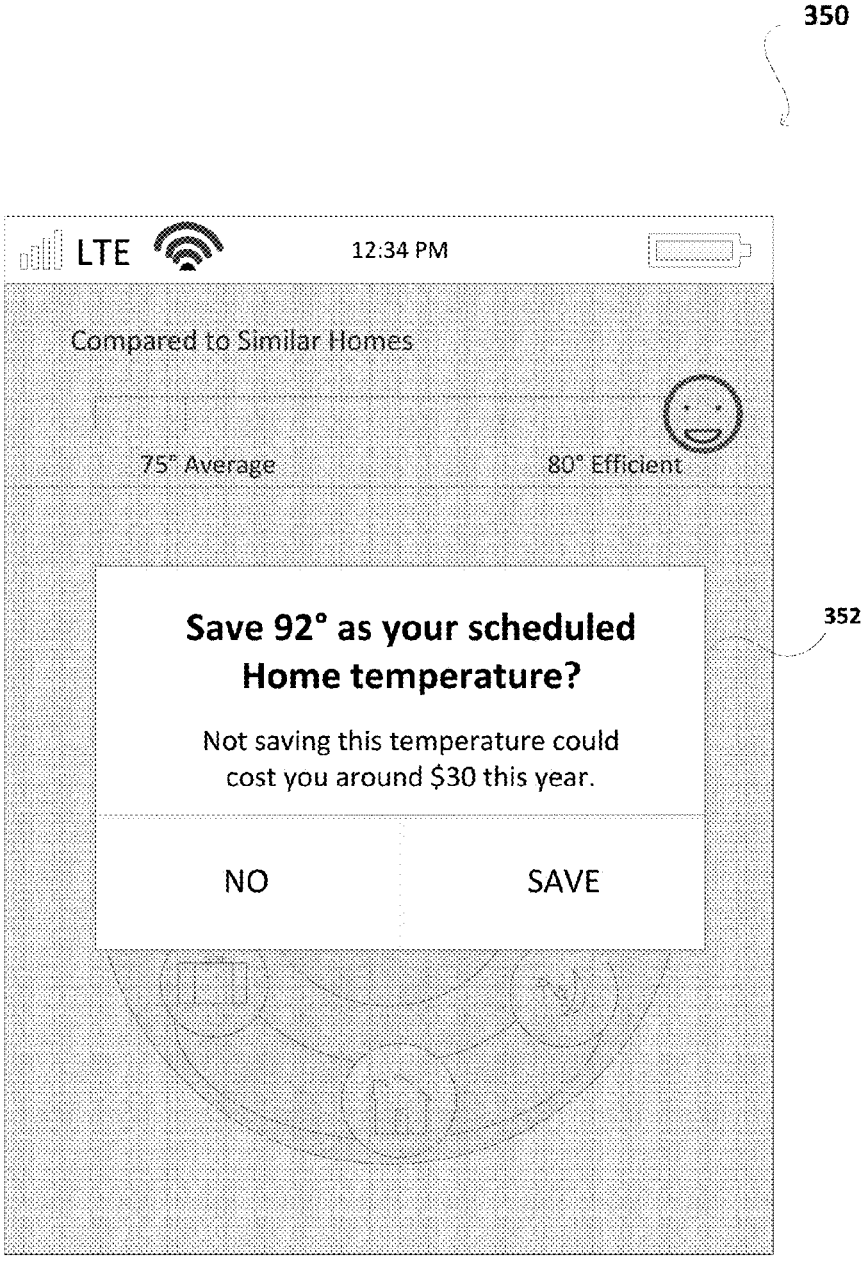

FIG. 3B illustrates an example of a setpoint schedule interface 350, according to certain aspects of the subject technology. The setpoint schedule interface 350 includes a prompt 352 to inform the user of how much the temperature (corresponding to the originally-scheduled setpoint) could cost them by not saving the new temperature (corresponding to the current setpoint). In other words, the prompt 352 can inform the user how much the user can save by adopting the alternative setpoint (e.g., the new temperature). The prompt 352 may be triggered in response to the user manually changing the temperature to a more efficient setting than the previously scheduled setting. In an aspect, the prompt 352 questions whether the user would like to save the new setpoint to the existing setpoint schedule. In this regard, the new setpoint may replace an existing setpoint or be added as an additional setpoint.

Figure 4:
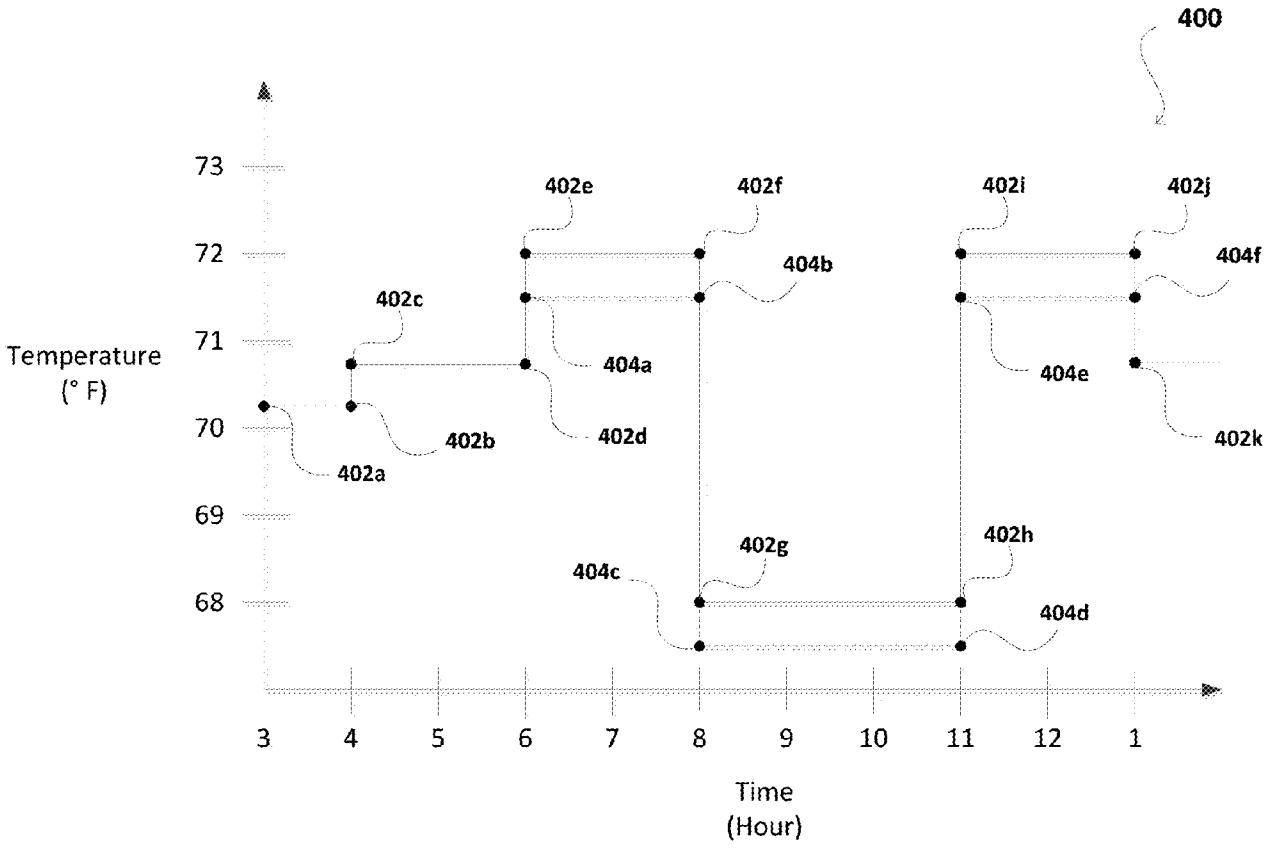
FIG. 4 illustrates an example of a set point schedule, according to certain aspects of the subject technology.

FIG. 4 illustrates an example of a setpoint schedule 400, according to certain aspects of the subject technology. The setpoint schedule 400 includes a plot of temperature setpoints as a function of time. In this respect, the setpoint schedule 400 describes a programming schedule for a climate control device such that the climate in the corresponding property can be set to a particular temperature (e.g., y-axis) at a corresponding hour in the day (e.g., x-axis).

In this example, the setpoint schedule 400 includes an original schedule comprised of setpoints 402*a-k*. The property may be set to a temperature of 70.25° F. at 3 a.m. and changes to the temperature 70.75° F. at 4 a.m. based on the schedule 400. At 6 a.m., the temperature is increased from 70.75° F. to 72° F., which remains at that temperature until 8 a.m. where the temperature is reduced down to 68° F. At 11 a.m., the temperature is raised from 68° F. to 72° F., and remains at that temperature until 1 p.m., where the temperature is reduced down to 70.75° F. The computing device may determine that the projected bill at the current setting (e.g., using the original schedule) may yield a utility bill that exceeds the target budget for the corresponding utility customer. In this respect, the setpoint schedule 400 may be adjusted to a new setpoint schedule based on a recommendation to reduce the actual energy usage to keep the projected bill within the budgeted amount, and thereby yield monetary savings for the corresponding utility customer. The adjusted setpoint scheduled may be comprised of setpoints 402*a-d*, 402*g-h*, 402*k* and 404*a-f*. In this example, separate adjustments are made between 6 a.m. and 8 a.m., between 8 a.m. and 11 a.m., and between 11 a.m. and 1 p.m. For example, the temperature is reduced by ½ a degree for each of the corresponding ranges of time. As a result, the adjusted setpoint schedule with the reduced temperature setpoints can yield a lower projected bill for the corresponding utility customer. In some aspects, the adjusted setpoint schedule can be communicated to the climate control device to be automatically performed and confirmed by the corresponding utility customer. In another aspect, the adjusted setpoint schedule may be included in the setpoint schedule interface 300 (FIG. 3) to guide the utility customer on how to adjust the settings of the climate control devices.

Figure 5:
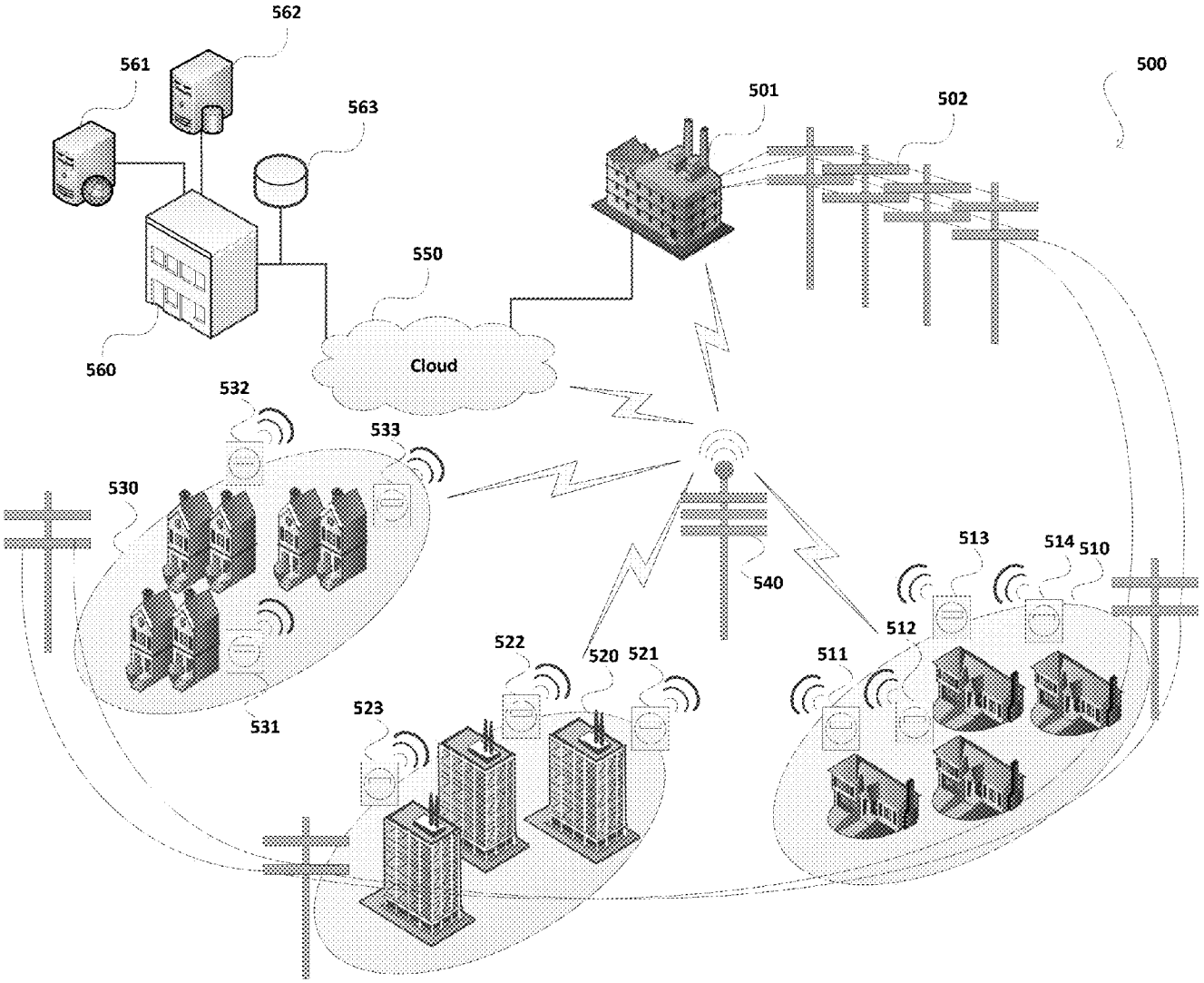
FIG. 5 illustrates an example of an environment for implementing aspects in accordance with various embodiments.

FIG. 5 illustrates an example of an environment 500 for implementing aspects in accordance with various embodiments. The environment 500 includes a utility company 501, power distribution system 502, utility customer regions 510, 520 and 530, energy usage collector 540, a network 550 and an energy usage management system 560. The utility customer region 510 includes residential structures with corresponding smart meters 511-514. The utility customer region 520 includes commercial structures with corresponding smart meters 521-523. The utility customer region 530 includes multi-family structures with corresponding smart meters 531-533. The energy usage management system 560 includes a web server 561, an application server 562 and a database 563.

The utility company 501 provides a commodity (e.g., electricity, gas, water) to the utility customer regions 510, 520 and 530. The utility company 501 may track the energy usage from each region via a monitoring device (e.g., a smart meter) associated with each structure of the corresponding region. The utility company 501 may receive usage data that includes the amount of energy consumption (e.g., kWh) for the corresponding utility account. In an aspect, the utility company 501 receives the usage data from the energy usage collector 540 via a wireless communication system. In some aspects, the energy usage collector 540 may obtain the usage data by pulling the usage data from each of the smart meter devices. The smart meter devices may broadcast usage data on a periodic or scheduled basis. The utility company 501 also may receive the usage data from each monitoring device through a wired communication system.

The energy usage management system 560 is in communication with the utility company 501 via the network 550. The energy usage management system 560 may obtain the usage data from the utility company 501 via the network 550. In an aspect, the energy usage management system 560 receives the usage data via the network 550. The energy usage management system 560 may receive the usage data directly from the smart meter devices.

Each of the utility customer regions 510, 520 and 530 may correspond to a separate geographical location with a respective rate schedule. In some aspects, an energy usage notification for a corresponding utility customer in one region may be generated using usage data of similar users in the same region to provide the corresponding utility customer with a comparative analysis of its energy consumption (e.g., current energy usage compared to similar customers in the same zip code or within a certain radius).

The energy usage management system 560 also may be in communication with a third party weather service, such as the National Weather Service (not shown). For example, the energy usage management system 560 may receive corresponding outdoor temperatures from the third party weather service via the network 550 (e.g., e-mails, downloaded FTP files, and XML feeds). In this respect, the energy usage management system 560 may use data from the third party weather service to determine a projected use for a current billing period. For example, forecasted weather conditions (e.g., the temperature, the humidity, the barometric pressure, precipitation, etc.) may indicate that the utility customer's HVAC system is likely to be in greater use. The energy usage management system 560 may estimate the projected use under a current setpoint schedule for the remaining amount of time of a current billing period, and thereby determine if the utility customer is on pace to exceed a projected bill based on the estimated projected use. In this respect, the energy usage management system 560 can generate one or more recommendations to adjust the current setpoint schedule in order to encourage energy conservation practices. In turn, the energy usage management system 560 may notify the utility customer through the energy usage notification.

The energy usage management system 560 communicates the energy usage notification to utility customers associated with the utility customer regions 510, 520 and 530. In some aspects, the energy usage management system 560 communicates the energy usage notification via the network 550. For example, the energy usage management system 560 may send the energy usage notification in an e-mail or the utility customer may log into the energy usage management system 560 (e.g., the web server 561 and/or application server 562) through an associated website to view the disaggregated usage data included in the energy usage alert notification. In other embodiments, the energy usage information including billing information is communicated back to the utility company 501 such that the utility company 501 can provide the energy usage notification to the utility customer.

FIG. 6 illustrates an example of a system 600 for saving energy efficient setpoints, according to certain aspects of the subject technology. Although a web-based environment is described for purposes of explanation, different environments may be used, as appropriate, to implement various embodiments.

The example system 600 includes an energy usage management system 605 and a data plane 610. The energy usage management system 605 includes at least one web server 606 and at least one application server 608, as described below. The energy usage management system 605 is an example of a setpoint scheduling system implemented as computer programs on one or more computers in one or more locations, in which the systems, components, and techniques described below, can be implemented.

A user can interact with the energy usage management system 605 through a client device 602. For example, the client device 602 can be a computer coupled to the energy usage management system 605 through a data communication network 604, e.g., the Internet. In some instances, the energy usage management system 605 can be implemented on the client device 602, for example, through a software application executing on the client device 602. The client device 602 generally includes a memory, e.g., a random access memory (RAM), for storing instructions and data, and a processor for executing stored instructions. The client device 602 can be any appropriate device operable to send and receive requests, messages, or other types of information over the data communication network 604. The client device 602 can also include a display screen though which the user interacting with the client device 602 can view information, e.g., setpoint schedule interface 300 of FIG. 3. Some examples of client devices include personal computers, smart thermostats, cellular phones, handheld messaging devices, laptop computers, set-top boxes, personal data assistants, electronic book readers, tablet devices, smartphones and the like.

The data communication network 604 can include any appropriate network, including an intranet, the Internet, a cellular network, a local area network, a wide area network, or any other such network, or combination thereof. Components used for such a system can depend at least in part upon the type of network, the environment selected, or both. Protocols and components for communicating over such a network are well known and will not be discussed herein in detail. The client device 602 can communicate over the data communication network 604 using wired or wireless connections, and combinations thereof.

A user can use the client device 602 to submit a request 620 to log into the energy usage management system 605. The request 620 can request data representing information included in a setpoint schedule for a corresponding utility account. The setpoint schedule may correspond to temperature settings for a climate control device associated with the corresponding utility customer. The setpoint schedule may include information relating to temperature settings for different times during a specified time period. The setpoint schedule also may include information relating to predefined temperature settings based on the user's location with respect to the home. When the user submits the request 620, the request 620 may be transmitted through the data communication network 604 to the application server 608 within the energy usage management system 605. The application server 608 responds to the request 620 by using, for example, schedule data 612, to identify data 622 describing an existing setpoint schedule in response to the request 620. The application server 608 sends the data 622 through the data communication network 604 to the client device 602 for presentation to the user.

The data 622 can include data describing a user interface for manipulating the setpoint schedule. The data 622 can be used, for example, by the client device 602, to generate a local setpoint schedule interface with one or more interactive features such as a temperature dial, themed setpoint buttons and/or control buttons to manipulate the temperature dial.

After receiving the data 622 from the application server 608, and through the data communication network 604, a software application, e.g., web browser or application 624, running on the client device 602 renders an interactive setpoint schedule interface using the data 622. For example, a setpoint engine 626 in the application 624 can detect when a current setpoint causes a decrease in energy consumption and/or when the current setpoint causes a particular financial benefit (e.g., cost savings) to the user, for display on a display screen of the client device 602.

In some aspects, the application 624 includes a climate control engine 628 that is configured to render an interface to the climate control device, and perform one or more actions related to the instructions for adjusting the settings of the climate control device. In some embodiments, the climate control engine 628 is configured to obtain data relating to current settings of the climate control device. The climate control engine 628 can obtain real-time statistics and/or sensor readings (e.g., thermometer reading) of current climate conditions in the home.

In some embodiments, the web server 606, the application server 608, and similar components, can be considered to be part of the data plane 610. The handling of all requests and responses, as well as the delivery of content between the client device 602 and the application server 608, can be handled by the web server 606. The web server 606 and the application server 608 are merely example components. However, more or fewer components can be used as structured code can be executed on any appropriate device or host machine as discussed elsewhere herein.

The data plane 610 includes one or more resources, servers, hosts, instances, routers, switches, data stores, other similar components, or a combination thereof. The resources of the data plane 610 are not limited to storing and providing access to data. Indeed, there may be several servers, layers, or other elements, processes, or components, which may be chained or otherwise configured, and which can interact to perform tasks including, for example, obtaining data from an appropriate data store. In some embodiments, the term "data store" refers to any device or combination of devices capable of storing, accessing, and retrieving data, which may include any combination and number of data servers, databases, data storage devices, and data storage media, in any standard, distributed, or clustered environment.

The data stores of the data plane 610 can include several separate data tables, databases, or other data storage mechanisms and media for storing data relating to a particular aspect. For example, the data plane 610 illustrated includes mechanisms for storing usage data 612 and user information 616, which can be used to generate the setpoint schedule. The data plane 610 is also shown to include a mechanism for storing similar user data 614, which can be used for purposes such as reporting a comparative analysis of the usage data for the corresponding utility customer. The data plane 610 is operable, through logic associated therewith, to receive instructions from the application server 608 and to obtain, update, or otherwise process data, instructions, or other such information in response thereto, as described above.

Each server typically includes an operating system that provides executable program instructions for the general administration and operation of that server, and typically will include a computer-readable medium storing instructions that, when executed by a processor of the server, enable the server to perform its intended functions. Suitable implementations for the operating system and general functionality of the servers are known or commercially available, and are readily implemented by persons having ordinary skill in the art, particularly in light of the disclosure herein.

The environment in one embodiment is a distributed computing environment including several computer systems and components that are interconnected through one or more communication links, using one or more computer networks or direct connections. However, the system described above can be configured to operate equally well using fewer or a greater number of components than are illustrated in FIG. 6. Thus, the system 600 in FIG. 6 is provided merely as one example, and does not limit the scope of the disclosure.

Figure 7:
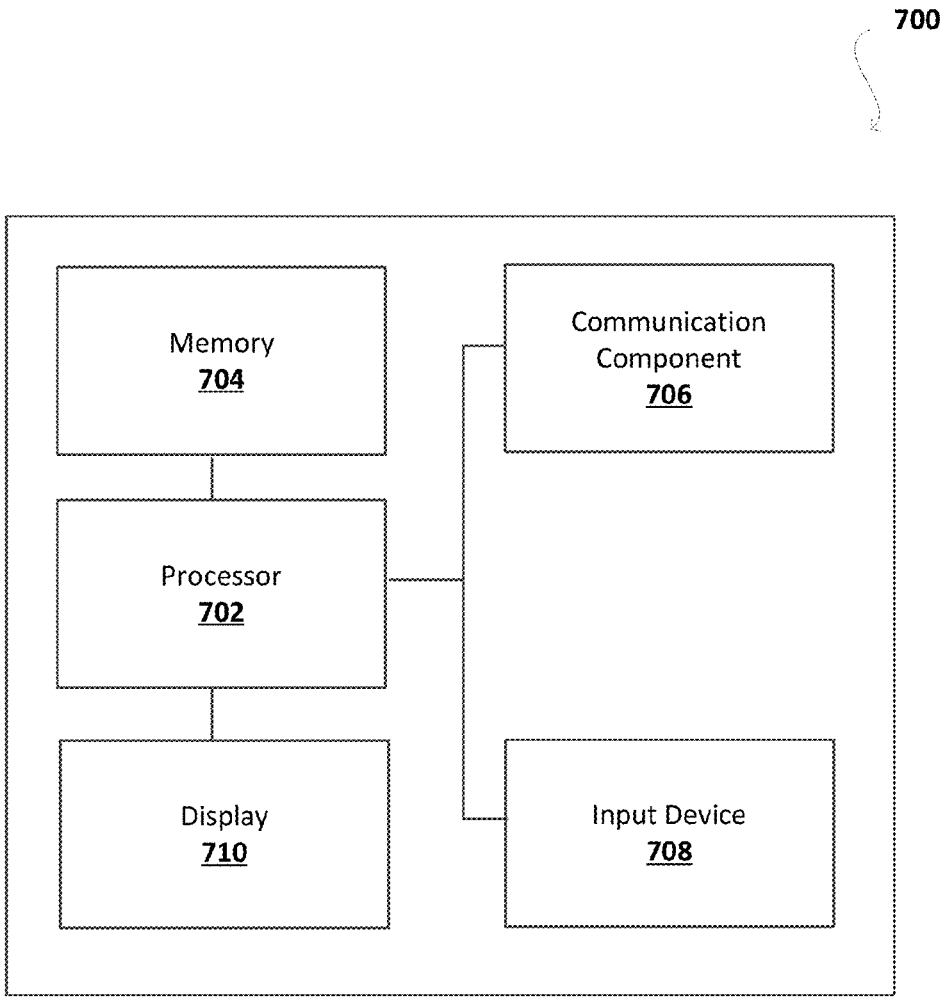
FIG. 7 illustrates an example configuration of components of a computing device, according to certain aspects of the subject technology.

FIG. 7 illustrates an example configuration of components of a client computing device 700, e.g., the climate control devices 103*a*-103*n* of FIG. 1, according to certain aspects of the subject technology. In this example, the client computing device 700 includes a processor 702 for executing instructions that can be stored in a memory device or element 704. The instructions may cause the client computing device 700 to execute a computer-implemented method for processing setpoint schedules from the energy usage management system 100 (FIG. 1) and/or receive instructions to adjust setpoint schedules (e.g., temperature settings) associated with the client computing device 700. As would be apparent to one of ordinary skill in the art, the client computing device 700 can include many types of memory, data storage, or non-transitory computer-readable storage media, such as a first data storage for program instructions for execution by the processor 702, a separate storage for usage history or user information, a removable memory for sharing information with other devices, etc. In some embodiments, the client computing device 700 can include one or more communication components 706, such as a Wi-Fi, Bluetooth®, radio frequency, near-field communication, wired, or wireless communication system. The client computing device 700 in many embodiments can communicate with a network, such as the Internet, and may be able to communicate with other such devices (e.g., the energy usage system 100, other climate control devices).

As discussed, the client computing device 700 in many embodiments will include at least one input element 708 able to receive conventional input from a user. This conventional input can include, for example, a push button, touch pad, touch screen, wheel, joystick, keyboard, mouse, keypad, or any other such device or element whereby a user can input a command to the device. In some embodiments, however, such a device might not include any buttons at all, and might be controlled only through a combination of visual and audio commands, such that a user can control the device without having to be in physical contact with the device. The client computing device 700 includes some type of display element 710, such as a touch screen or liquid crystal display (LCD).

The various embodiments can be implemented in a wide variety of operating environments, which in some cases can include one or more user computers, computing devices, or processing devices which can be used to operate any of a number of applications. User or client devices can include any of a number of general purpose personal computers, such as desktop or laptop computers running a standard operating system, as well as cellular, wireless, and handheld devices running mobile software and capable of supporting a number of networking and messaging protocols. Such a system also can include a number of workstations running any of a variety of commercially-available operating systems and other known applications for purposes such as development and database management. These devices also can include other electronic devices, such as dummy terminals, thin-clients, gaming systems, and other devices capable of communicating via a network.

Various aspects also can be implemented as part of at least one service or Web service, such as may be part of a service-oriented architecture. Services such as Web services can communicate using any appropriate type of messaging, such as by using messages in extensible markup language (XML) format and exchanged using an appropriate protocol such as SOAP (derived from the "Simple Object Access Protocol"). Processes provided or executed by such services can be written in any appropriate language, such as the Web Services Description Language (WSDL). Using a language such as WSDL allows for functionality such as the automated generation of client-side code in various SOAP frameworks.

Most embodiments utilize at least one network that would be familiar to those skilled in the art for supporting communications using any of a variety of commercially-available protocols, such as TCP/IP, OSI, FTP, UPnP, NFS, and CIFS. The network can be, for example, a local area network, a wide-area network, a virtual private network, the Internet, an intranet, an extranet, a public switched telephone network, an infrared network, a wireless network, and any combination thereof.

In embodiments utilizing a Web server, the Web server can run any of a variety of server or mid-tier applications, including HTTP servers, FTP servers, CGI servers, data servers, Java servers, and business map servers. The server(s) also may be capable of executing programs or scripts in response requests from user devices, such as by executing one or more Web applications that may be implemented as one or more scripts or programs written in any programming language, such as Java®, C, C# or C++, or any scripting language, such as Perl, Python, or TCL, as well as combinations thereof. The server(s) may also include database servers, including without limitation those commercially available from Oracle®, Microsoft®, Sybase®, and IBM®.

The environment can include a variety of data stores and other memory and storage media as discussed above. These can reside in a variety of locations, such as on a storage medium local to (and/or resident in) one or more of the computers or remote from any or all of the computers across the network. In a particular set of embodiments, the information may reside in a storage-area network ("SAN") familiar to those skilled in the art. Similarly, any necessary files for performing the functions attributed to the computers, servers, or other network devices may be stored locally and/or remotely, as appropriate. Where a system includes computerized devices, each such device can include hardware elements that may be electrically coupled via a bus, the elements including, for example, at least one central processing unit (CPU), at least one input device (e.g., a mouse, keyboard, controller, touch screen, or keypad), and at least one output device (e.g., a display device, printer, or speaker). Such a system may also include one or more storage devices, such as disk drives, optical storage devices, and solid-state storage devices such as random access memory ("RAM") or read-only memory ("ROM"), as well as removable media devices, memory cards, flash cards, etc.

Such devices also can include a computer-readable storage media reader, a communications device (e.g., a modem, a network card (wireless or wired), an infrared communication device, etc.), and working memory as described above. The computer-readable storage media reader can be connected with, or configured to receive, a computer-readable storage medium, representing remote, local, fixed, and/or removable storage devices as well as storage media for temporarily and/or more permanently containing, storing, transmitting, and retrieving computer-readable information. The system and various devices also typically will include a number of software applications, modules, services, or other elements located within at least one working memory device, including an operating system and application programs, such as a client application or Web browser. It should be appreciated that alternate embodiments may have numerous variations from that described above. For example, customized hardware might also be used and/or particular elements might be implemented in hardware, software (including portable software, such as applets), or both. Further, connection to other computing devices such as network input/output devices may be employed.

Storage media and computer readable media for containing code, or portions of code, can include any appropriate media known or used in the art, including storage media and communication media, such as but not limited to volatile and non-volatile, removable and non-removable media implemented in any method or technology for storage and/or transmission of information such as computer readable instructions, data structures, program modules, or other data, including RAM, ROM, EEPROM, flash memory or other memory technology, CD-ROM, digital versatile disk (DVD) or other optical storage, magnetic cassettes, magnetic tape, magnetic disk storage or other magnetic storage devices, or any other medium which can be used to store the desired information and which can be accessed by the a system device. Based on the disclosure and teachings provided herein, a person of ordinary skill in the art will appreciate other ways and/or methods to implement the various embodiments.

The specification and drawings are, accordingly, to be regarded in an illustrative rather than a restrictive sense. It will, however, be evident that various modifications and changes may be made thereunto without departing from the broader spirit and scope of the disclosure as set forth in the claims.

The description of the subject technology is provided to enable any person skilled in the art to practice the various embodiments described herein. While the subject technology has been particularly described with reference to the various figures and embodiments, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these embodiments will be readily apparent to those skilled in the art, and generic principles defined herein may be applied to other embodiments. Thus, many changes and modifications may be made to the subject technology, by one having ordinary skill in the art, without departing from the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various embodiments described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A computing device for saving energy efficient setpoints, the computing device comprising:

at least one processor; and memory storing instructions that, when executed by the at least one processor, cause the computing device to:

detect a change in a setpoint schedule based on setpoint data from a client computing device, the setpoint schedule including one or more setpoints that correspond to different temperature settings;

determine that the change in the setpoint schedule decreases energy consumption for a user;

identify a set of setpoint schedules associated with a plurality of climate control devices;

compare the setpoint schedule of the user to the set of setpoint schedules to determine an indication of an efficiency of energy consumption of the user compared to efficiencies of energy consumption of a plurality of users associated with the plurality climate control devices;

send data to the client computing device to cause a prompt to be displayed on a user interface of the client computing device, the prompt including the indication and one or more options including an option to adopt the change in the setpoint schedule using the setpoint data; and receive an input based at least in part on the prompt, the input including a selection of the option causing a change in the setpoint schedule using the setpoint data resulting in modified operation of a climate control device.

2. The computing device of claim 1, wherein the change in the setpoint schedule is detected based at least in part on a difference between a current setpoint included in the setpoint data and a scheduled setpoint included in the setpoint schedule, and wherein the difference corresponds to an amount of degrees difference in temperature.

3. The computing device of claim 2, wherein the instructions further cause the computing device to determine that the amount of degrees is greater than a first threshold, and wherein the change is determined to decrease energy consumption based on the amount of degrees being greater than the first threshold.

4. The computing device of claim 1, wherein the instructions further cause the computing device to:

determine that the change in the setpoint schedule corresponds to a projected financial benefit that is greater than a threshold, the projected financial benefit relating to a financial benefit to the user for one or more billing cycles;

generate a notification including information relating to the projected financial benefit to inform the user that the projected financial benefit is based on the user adopting a current setpoint included in the setpoint data as a new scheduled setpoint in the setpoint schedule; and send the notification to the client computing device to cause the prompt to be displayed on the user interface, the prompt including the information relating to the projected financial benefit.

5. The computing device of claim 4, wherein the notification includes information relating to how much a decision of the user will save the user in comparison to a current practice of the user.

6. The computing device of claim 1, wherein the instructions further cause the computing device to:

obtain the setpoint schedule from a repository communicatively coupled to the client computing device; and receive a request from the client computing device to change a scheduled setpoint included in the setpoint schedule to a current setpoint included in the request, wherein the change in the setpoint schedule is detected in response to the request.

7. The computing device of claim 1, wherein the instructions further cause the computing device to:

obtain the setpoint schedule as an original setpoint schedule;

adjust the setpoint schedule by at least one or more of replacing a scheduled setpoint included in the setpoint schedule with a current setpoint included in the setpoint data or adding the current setpoint into the setpoint schedule; and store the adjusted setpoint schedule as a new setpoint schedule.

8. The computing device of claim 1, wherein the user interface is associated with an application configured to run on the client computing device.

9. The computing device of claim 1, wherein the user interface comprises an object representing a temperature dial for controlling one or more scheduled setpoints of the setpoint schedule, wherein the instructions further cause the computing device to detect one or more touch gestures on the temperature dial, wherein the one or more touch gestures correspond to a manipulation of the temperature dial to provide at least one input to the user interface, and wherein the at least one input corresponds to the change detected in the setpoint schedule.

10. The computing device of claim 1, wherein the user interface comprises an object representing a metric of the efficiencies of energy consumption of the plurality of users.

11. The computing device of claim 9, wherein the at least one input corresponds to a current setpoint of the setpoint data, wherein the instructions further cause the computing device to determine that the current setpoint is smaller than a scheduled setpoint of the setpoint schedule, and wherein the change detected in the setpoint schedule relates to an improvement in energy conservation based on the current setpoint being smaller than the scheduled setpoint when the climate control device is set to a heating mode.

12. The computing device of claim 9, wherein the instructions further cause the computing device to determine that a current setpoint of the setpoint data is greater than a scheduled setpoint of the setpoint schedule, and wherein the change detected in the setpoint schedule relates to an improvement in energy conservation based on the current setpoint being greater than the scheduled setpoint when the climate control device is set to a cooling mode.

13. The computing device of claim 1, wherein the instructions further cause the computing device to:

send data to the client computing device to cause the climate control device associated with the client computing device to be set into a cooling mode;

determine that a current setpoint included in the setpoint data is greater than a scheduled setpoint included in the setpoint schedule; and send a notification to the client computing device based on the current setpoint being greater than the scheduled setpoint, wherein the notification includes information to inform the user of a projected financial benefit that would result from the current setpoint being stored as part of the setpoint schedule.

14. The computing device of claim 13, wherein the instructions further cause the computing device to:

send additional data to the client computing device to cause the climate control device to be set into a heating mode;

determine that the current setpoint is smaller than the scheduled setpoint; and send the notification to the client computing device based on the current setpoint determined to be smaller than the scheduled setpoint.

15. The computing device of claim 14, wherein the instructions further cause the computing device to:

determine that the projected financial benefit is greater than a predetermined threshold;

generate a notification including loss-aversion information to incentivize the user to adopt the current setpoint; and send data including the notification to cause the prompt to be displayed on the user interface, the prompt including the loss-aversion information.

16. The computing device of claim 15, wherein the projected financial benefit is based at least in part on an energy usage history of the user relating to one or more of an average usage rate for a specified number of months, a usage rate during a specified budget period for one or more previous years, an average usage rate for a particular weekday or weekend, usage rates for one or more months preceding the specified budget period, and energy usage billing information for a specified number of months in one or more previous years.

17. A computer-implemented method for saving energy efficient setpoints, the method comprising:

detecting a change in a setpoint schedule based on setpoint data from a client computing device, the setpoint schedule including one or more setpoints that correspond to different temperature settings;

determining that the change in the setpoint schedule decreases energy consumption for a user;

identifying a set of setpoint schedules associated with a plurality of climate control devices;

comparing the setpoint schedule of the user to the set of setpoint schedules to determine an indication of an efficiency of energy consumption of the user compared to efficiencies of energy consumption of a plurality of users associated with the plurality climate control devices;

sending data to the client computing device to cause a prompt to be displayed on a user interface of the client computing device, the prompt including the indication and one or more options including an option to adopt the change in the setpoint schedule using the setpoint data; and receiving an input based at least in part on the prompt, the input including a selection of the option causing a change in the setpoint schedule using the setpoint data resulting in modified operation of a climate control device.

18. The computer-implemented method of claim 17, further comprising:

determining that a current setpoint included in the setpoint data is deviated from a scheduled setpoint included in the setpoint schedule by an amount of degrees that represents a decrease in energy consumption based on the specified climate mode, wherein a notification is sent to the user that includes information to inform the user of a projected financial benefit that would result from the current setpoint being stored as part of the setpoint schedule.

19. A non-transitory computer readable storage medium storing instructions for saving energy efficient setpoints on a computing device, the instructions when executed by a processor causing the processor to:

detect a change in a setpoint schedule based on setpoint data from a client computing device, the setpoint schedule including one or more setpoints that correspond to different temperature settings;

determine that the change in the setpoint schedule decreases energy consumption for a user;

identify a set of setpoint schedules associated with a plurality of climate control devices;

compare the setpoint schedule of the user to the set of setpoint schedules to determine an indication of an efficiency of energy consumption of the user compared to efficiencies of energy consumption of a plurality of users associated with the plurality climate control devices;

send data to the client computing device to cause a prompt to be displayed on a user interface of the client computing device, the prompt including the indication and one or more options including an option to adopt the change in the setpoint schedule using the setpoint data; and receive an input based at least in part on the prompt, the input including a selection of the option causing a change in the setpoint schedule resulting in modified operation of a climate control device.

20. The non-transitory computer readable storage medium of claim 19, wherein the instructions further cause the processor to:

determine that a current setpoint included in the setpoint data is deviated from a scheduled setpoint included in the setpoint schedule by an amount of degrees that represents a decrease in energy consumption based on the specified climate mode wherein a notification is sent to the user that includes information to inform the user of a projected financial benefit that would result from the current setpoint being stored as part of the setpoint schedule.

21. The non-transitory computer readable storage medium of claim 19, wherein the user interface comprises an object representing the set of setpoint schedules of the plurality of users.

* * * * *